US006971179B2

(12) United States Patent
Erbrick

(10) Patent No.: US 6,971,179 B2
(45) Date of Patent: Dec. 6, 2005

(54) CUTTING TOOL

(75) Inventor: Robert S. Erbrick, Doylestown, PA (US)

(73) Assignee: Electroline Corporation, Pipersville, PA (US)

( * ) Notice: Subject to any disclaimer, the term of this patent is extended or adjusted under 35 U.S.C. 154(b) by 68 days.

(21) Appl. No.: 10/256,617

(22) Filed: Sep. 27, 2002

(65) Prior Publication Data

US 2004/0060177 A1 Apr. 1, 2004

(51) Int. Cl.[7] ..... B26B 17/02
(52) U.S. Cl. ..... 30/191; 30/180
(58) Field of Search ..... 30/191–193, 308.2, 30/180

(56) References Cited

U.S. PATENT DOCUMENTS

| | | | | | |
|---|---|---|---|---|---|
| 102,006 | A | * | 4/1870 | Howard | 30/191 |
| 547,101 | A | * | 10/1895 | Williams | 30/192 |
| 2,256,779 | A | | 9/1941 | McHenry | |
| 2,341,654 | A | * | 2/1944 | Richter | 81/352 |
| 3,025,599 | A | | 3/1962 | Sauers et al. | |
| 3,358,541 | A | | 12/1967 | Frei | |
| 4,505,038 | A | * | 3/1985 | Porter | 30/193 |
| 4,747,212 | A | | 5/1988 | Cavdek | |
| 4,899,445 | A | | 2/1990 | Erbrick et al. | |
| 4,910,870 | A | * | 3/1990 | Chang | 30/192 |
| 4,998,351 | A | | 3/1991 | Hartmeister | |
| 5,187,869 | A | * | 2/1993 | Heiss | 30/189 |
| 5,195,353 | A | | 3/1993 | Erbrick et al. | |
| 5,272,811 | A | | 12/1993 | Armand | |
| 5,307,565 | A | | 5/1994 | Erbrick et al. | |
| 5,454,754 | A | | 10/1995 | Baertlein | |
| 5,590,470 | A | | 1/1997 | Erbrick et al. | |
| 5,755,293 | A | | 5/1998 | Bourke | |
| 6,178,643 | B1 | | 1/2001 | Erbrick et al. | |

* cited by examiner

*Primary Examiner*—Charles Goodman
(74) *Attorney, Agent, or Firm*—Akin Gump Strauss Hauer & Feld, LLP

(57) ABSTRACT

A cutting tool capable of cutting work pieces which are thicker than what comparably-sized conventional cutting tools are capable of cutting has a jaw with a cutting edge which does not completely abut or overlap over the full length of an opposing edge of a second jaw when the cutting tool is in its closed position. A resulting gap between the opposing edges varies from a maximum at the free end of the cutting edges to zero at a portion of the opposing edges where the edges abut one another. The cutting tool successively notches a work piece, and as the notch deepens, the work piece is advanced toward the abutting portion of the cutting edge and the opposing edge until it is finally severed. The jaws may be operated manually by hand levers or driven by hydraulic, pneumatic or electrical drive mechanisms.

25 Claims, 11 Drawing Sheets

CUTTING TOOL

BACKGROUND OF THE INVENTION

The present invention relates generally to cutting tools, and, more particularly, to cutting tools used for cutting solid, high strength materials such as metals.

Cutting tools are well-known. Conventional cutting tools generally include a pair of opposing jaws with sharpened edges which pivot such that the jaws can be operated to be separated and brought together, often using levers to actuate the jaws, forcing the sharpened edges against the material to be cut. The cutting stroke generally begins with the jaws being separated as the levers are moved apart, the material to be cut is inserted between the opened jaws, and the jaws are forced together as the levers are moved together, creating a force which exceeds the strength of the material within the jaws, thus cutting the material. Typically, the jaws come together in either a scissors shear cutting action, where the jaw edges overlap at the end of the cutting stroke or in a pliers cutting action, where the jaw edges abut one another at the end of the cutting stroke. The force imposed on the material for a given lever force increases as either the length of the levers (as measured from the point of application of force to the levers to the lever pivot point) increases or the distance between the pivot point and the work piece decreases.

A deficiency of the prior art is that conventional shear type cutting tools are not suitable for cutting relatively thick materials. When cutting very thin materials, shear type tools work well because the work piece can be entered and advanced successively with limited opening of the blades. However, as the thickness of the work piece increases, the cutting action becomes less efficient. With shear type cutting tools, twisting forces are developed by the non-aligned cutting members. As the thickness of the work piece increases, the twisting forces tend also to increase. Twisting forces are undesirable in that they tend to cause the blades to misalign (in turn tending to further increase the twisting forces), decreasing the cutting force applied to the work piece and potentially damaging the cutting edges.

Typically, tools with abutting jaws, such as pliers or bolt cutters, are used to cut relatively thick materials such as wire, bolts and rods. The abutting, in-line cutting action of these tools, where the cutting forces are in alignment, eliminates or minimizes the twisting forces characteristic of the shear type devices. However, conventional abutting jaw type devices do suffer from the deficiency that the jaws must be moved from their abutting closed position to an open position such that the jaws are spread sufficiently to accommodate the full thickness of the work piece, which typically requires substantial movement of the actuating levers. Furthermore, conventional abutting jaw devices are not well-suited for the work piece to be successively advanced into the jaws with limited blade movement.

BRIEF SUMMARY OF THE INVENTION

The invention is directed to a cutting tool comprising a first jaw having first and second ends and first and second edges extending between the first and second ends. At least a portion of the first edge of the first jaw forms a cutting edge between the first and the second ends. The cutting tool further comprises a second jaw having first and second ends and first and second edges extending between the first and second ends. At least a portion of the first edge of the second jaw faces the first edge of the first jaw. The first and second jaws are pivotally connected together such that the first edge of the first jaw and the first edge of the second jaw oppose one another and pivot between a closed and an open position. In the closed position, an angled gap is formed between the cutting edge of the first jaw and the facing portion of the first edge of the second jaw. The gap increases in size from zero at one end of the first edges to a finite value at an opposite end of the first edges.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
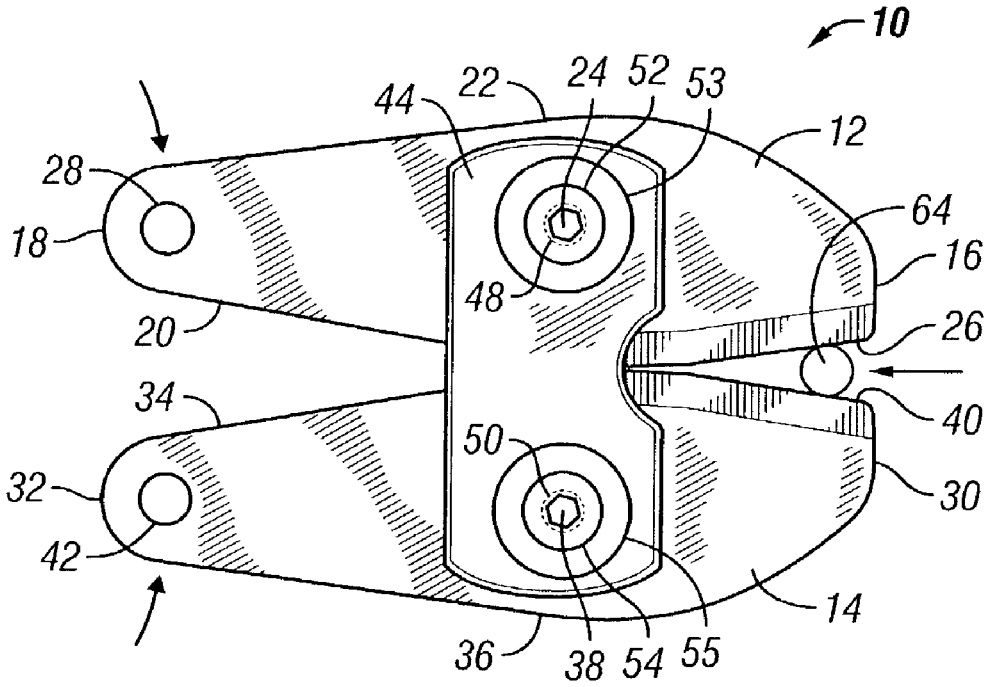
FIG. 1 is a right side elevational view of a cutting tool of the present invention, illustrating the jaws being opened and a work piece being inserted within the jaws.

A first preferred embodiment cutting tool jaw set of the present invention is shown in FIGS. 1–7 and is indicated generally at 10. The cutting tool is comprised of a first 12 and a second 14 jaw. The first jaw 12 has opposing, first 16 and second 18 ends, a first, outer edge 20 and a second inner edge 22 extending between the ends 16, 18. The first jaw 12 includes a pivot point 24 intermediate the first 16 and second 18 ends and the first 20 and second 22 edges. At least a portion of the first edge 20 of the first jaw 12 intermediate the pivot point 24 and the first end 16 is sharpened to form a cutting edge 26. The first jaw 12 also includes a through hole 28 proximate the second end 18. Similarly, the second jaw 14 also has opposing first 30 and second 32 ends, a first, outer edge 34 and second, inner edge 36 extending between the ends 30, 32. The second jaw 14 also includes a pivot point 38 intermediate the first 30 and second 32 ends and the first 34 and second 36 edges. At least a portion of the first edge 34 of the second jaw 14 intermediate the pivot point 38 and the first end 30 is sharpened to form a cutting edge 40. The second jaw 14 also includes a through hole 42 proximate the second end 32.

The first 12 and second 14 jaws are operably connected by a first assembly plate 44 and a second assembly plate 46. A first assembly hole 48 extends through the first assembly plate 44, through the first jaw 12 at pivot point 24 and through the second assembly plate 46. A second assembly hole 50 extends through the first assembly plate 44, through the second jaw 14 at pivot point 38 and through the second assembly plate 46. Fasteners 52, 54, for example bolts with nuts or rivets, extend through the assembly holes 48, 50. Washers 53 and 55 underlie fasteners 52 and 54.

Figure 2:
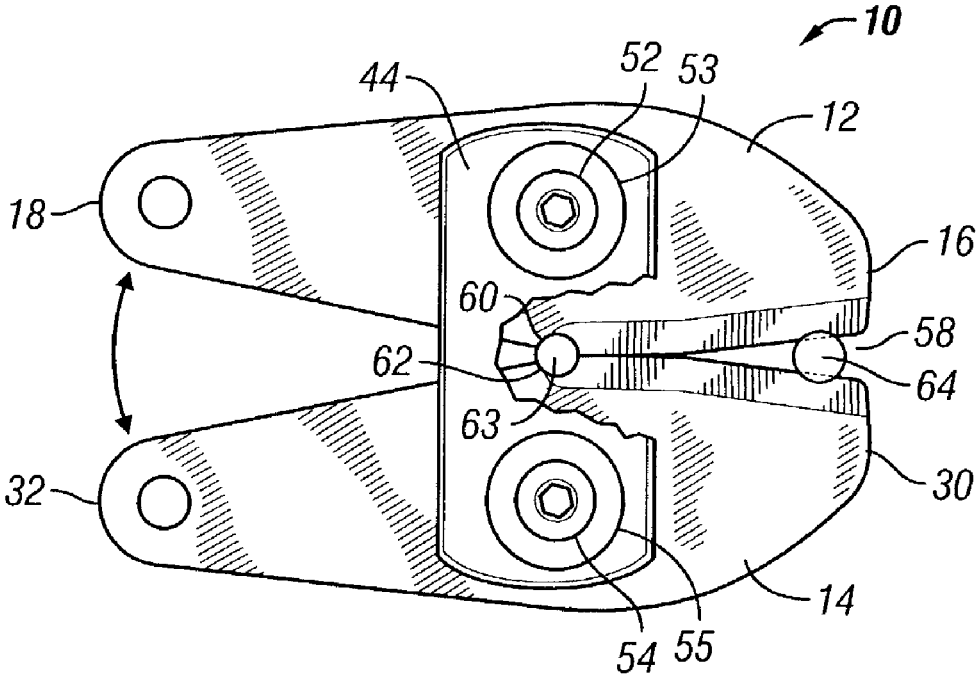
FIG. 2 is a right side elevational view of the cutting tool of FIG. 1, illustrating the jaws being closed down upon a work piece.
Figure 3:
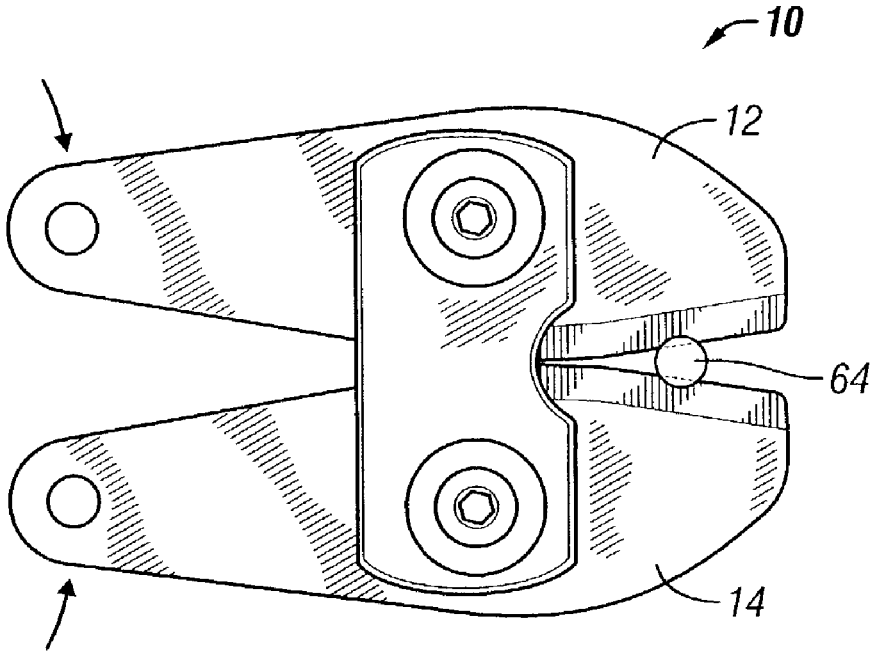
FIG. 3 is a right side elevational view of the cutting tool of FIG. 1, illustrating the jaws being opened and the work piece being advanced within the jaws after an initial cutting stroke has been made.
Figure 4:
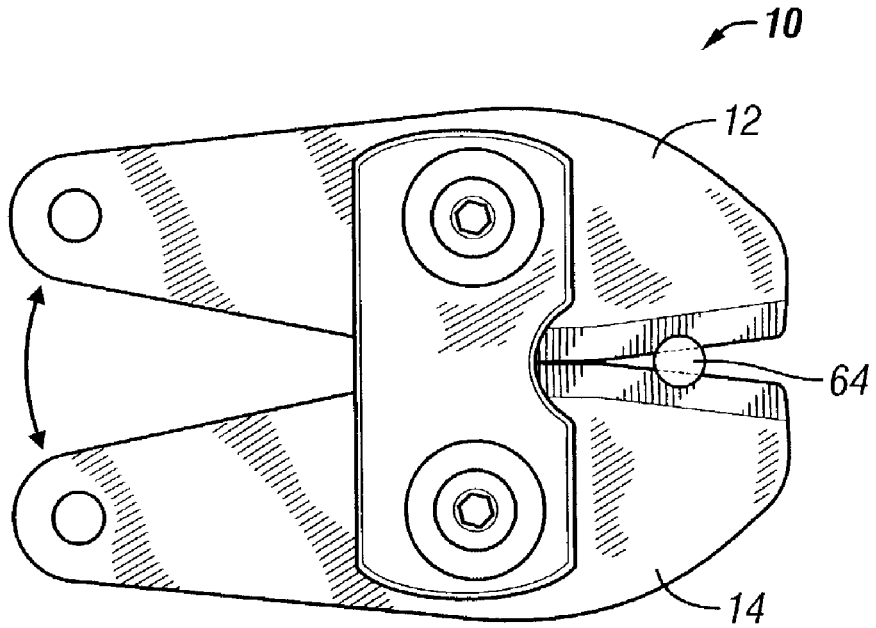
FIG. 4 is a right side elevational view of the cutting tool of FIG. 1, illustrating the jaws being closed upon the work piece in a second cutting stroke.
Figure 5:
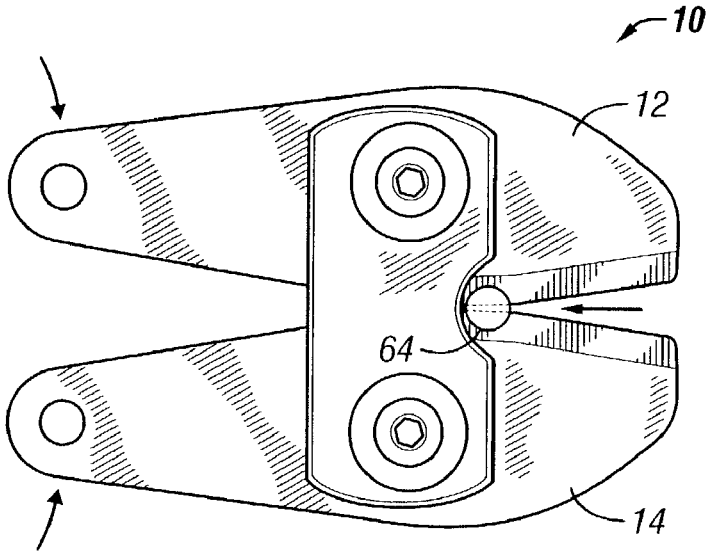
FIG. 5 is a right side elevational view of the cutting tool of FIG. 1, illustrating jaws being opened and the work piece being advanced for a final cutting stroke.
Figure 6:
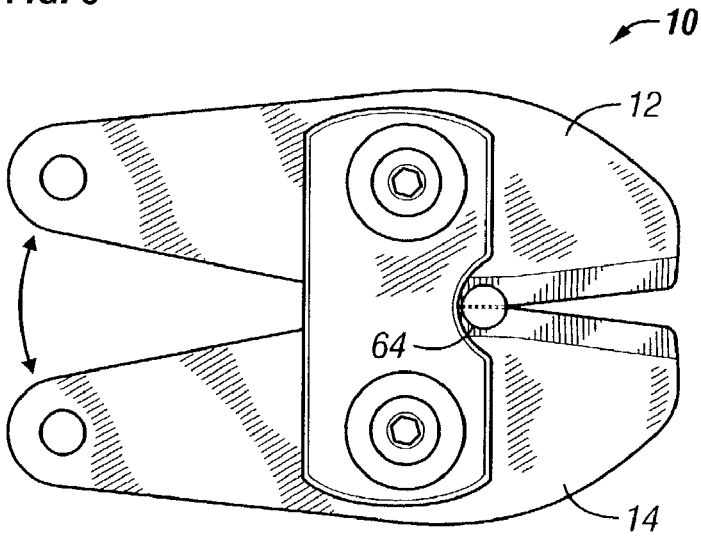
FIG. 6 is a right side elevational view of the cutting tool of FIG. 1, illustrating the jaws being closed down upon the work piece in a final cutting stroke, severing the work piece.
Figure 7:
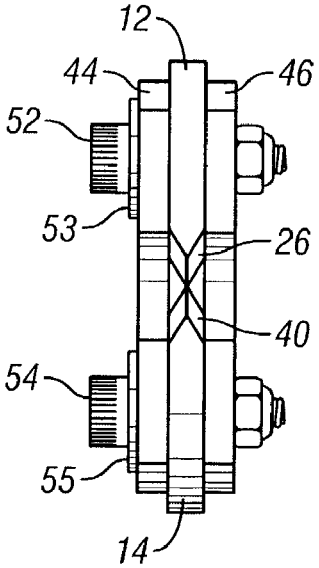
FIG. 7 is a front end view of the cutting tool of FIG. 1.

At the end of the cutting edges 26 and 40 proximate the pivot points 24 and 38, the edges abut together when the first 12 and second 14 jaws are in their closed position, forming an abutment section 56 (see FIG. 2). From this abutment section 56, the cutting edges 26 and 40 are angled away from one another, thus forming a gap 58, which increases in size from zero at the end of the abutting section 56 proximate to the first ends 16 and 30, to some finite value at the first ends 16 and 30. Note that at the opposite end of the abutment section 56, proximate the second ends 18 and 32, each jaw 12 and 14 has an opposing semicircular cut-out 60 and 62, which facilitate the jaws 12 and 14 to fully align with one another longitudinally during operation, by virtue of a fulcrum pin 63 which is inserted between the cut-outs 60 and 62. The fulcrum pin 63 is captured on its ends by the assembly plates 44 and 46. Another method for maintaining alignment of the first and second jaws 12, 14 would be to form meshing gear type surfaces on mating portions of the jaws 12 and 14. This method is described later herein under the discussion of the third embodiment of the invention.

The preferred material of construction for the cutting tool 10 is hardened tool steel. Other materials, for example, stainless steel or other combinations of materials, for example hardened tool steel for the jaws 12, 14 and polypropylene or ABS plastic for the plates 44, 46, could be substituted.

From this disclosure, it would be obvious to one skilled in the art to modify the arrangement of the jaws 12 and 14 as shown. For example, the jaws 12 and 14 could be modified to make the cutting edges 26 and 40 proportionally smaller or larger relative to other features of the jaws 12, 14. The size of the gap 58 or the length of the abutment section 56 could be increased or decreased, either in absolute terms or in proportion to the other features of the jaws 12, 14.

In operation, actuating forces are applied to the second ends 18 and 32 of the first 12 and second 14 jaws, respectively. The forces are preferably applied by force carrying members (not shown) connected to the first 12 and second 14 jaws at the through holes 28 and 42. When the forces are applied as indicated by the arrows in FIG. 1, the jaws 12 and 14 tend to pivot away from one another at their first ends 16 and 30, thus opening the gap 58 and separating the jaws 12, 14 from one another at the abutment section 56. A work piece 64 of a size suitable to fit within the gap 58 may then be inserted between the jaws 12 and 14, within the gap 58. As the directions of the applied forces are reversed, as indicated by the arrows in FIG. 2, the jaws 12 and 14 tend to pivot toward one another at their first ends 16 and 30. The jaws 12 and 14 continue to close together, resulting in a cutting stroke, up to the point where the jaws 12 and 14 fully abut one another at the abutment section 56. During this cutting stroke, the work piece 64 is notched. Note that the cutting tool 10 may be rotated about a work piece which is generally circular in cross-section, as is the work piece 64 illustrated in the Figs., scoring the work piece surface at multiple points about the circumference. As indicated by FIGS. 1–6, this cycle of alternatively opening the jaws 12 and 14, advancing the work piece 64 toward the abutment section 56, and closing the jaws 12 and 14 in a cutting stroke, incrementally notches the work piece 64 until it fully advances into the abutment section 56 and is completely severed. It should be noted that this incremental notching of the work piece 64 allows a relatively large work piece 64 to be severed by the cutting tool 10.

This incremental cutting action, in conjunction with the jaw gap 58, does not require the jaw ends 16 and 30 to move through an arc equal to the work piece 64 thickness as is required of conventional devices. Hence, the jaws 12 and 14 need be actuated only by that amount sufficient to score the work piece 64, such that the work piece 64 may be successively notched and advanced into the jaws 12 and 14. Because no large movement of the jaws 12 and 14 is required, the jaws 12 and 14 may be designed for optimal weight, strength and simplicity (note that the fulcrum pin 63, which is highly desirable for its low cost and simplicity, works best in jaw designs with limited motion). Equally important, a device which actuates the jaws 12 and 14 can be simplified and optimized for maximum actuating force over a limited range of jaw 12, 14 motion.

Figure 8:
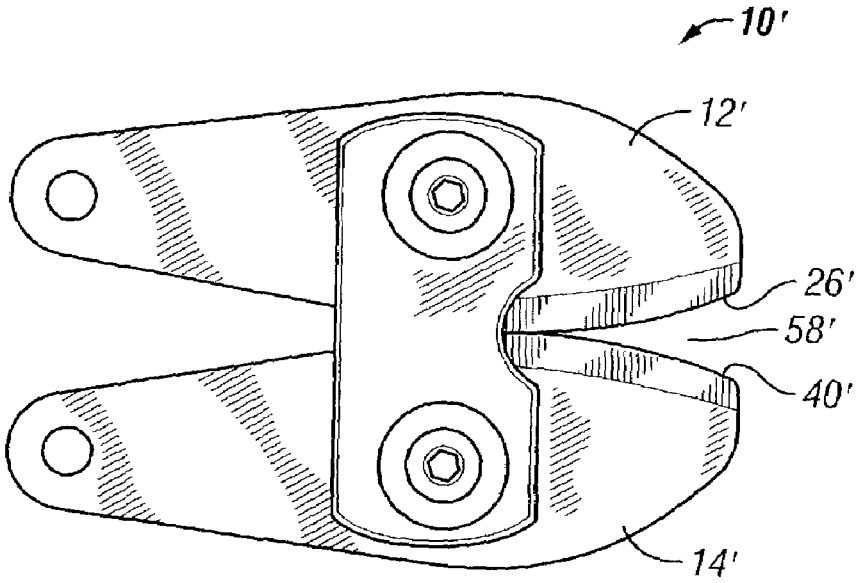
FIG. 8 is a right side elevational view of a second embodiment of the present invention, wherein the jaws of the cutting tool have cutting edges with non-linear profiles.

From this disclosure, it would be obvious to one skilled in the art to modify the profile of the cutting edges 26 and 40 to tailor the cutting tool 10 for different materials and applications. FIG. 8 illustrates a second embodiment of the cutting tool 10' where the profile of the cutting edges 26' and 40' is nonlinear, with the profile assuming a relatively steep angle at ends 16 and 30. The resulting wider gap 58' and more steeply angled profile would be best suited for relatively soft materials, (such as copper, wood or mild steels) which can be cut with relatively few advances. In contrast, a less steeply angled profile of cutting edges 26' and 40' combined with longer jaws 12' and 14' would be better suited for harder materials, such as hardened steels, which require numerous cuts and advances, and greater cutting forces. The profile could be further tailored for use with work pieces composed of a combination of materials (for example an Aluminum Conductor Steel Reinforced (ACSR) cable used in power transmission). Furthermore, serrations could be added to the cutting edges 26' and 40' to minimize slippage of the work piece 64.

From this disclosure, it would be further obvious to one skilled in the art that the jaws 12 and 14 may be actuated to rotate relative to one another by a variety of means. For example, rotation may be effected by manually-operated levers. Or the jaws 12 and 14 could be caused to rotate by an electrically, hydraulically or pneumatically driven motive force connected to the jaws 12 and 14 either directly or through a mechanical drive system.

Figure 9:
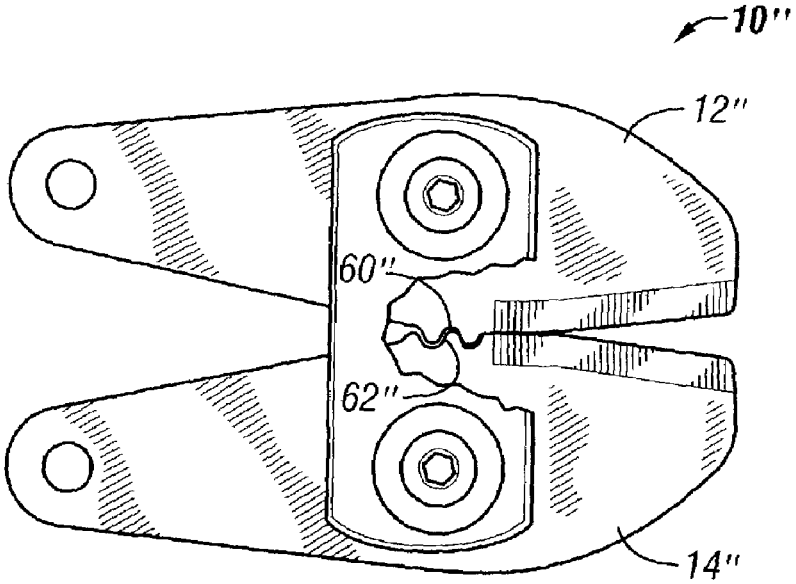
FIG. 9 is a right side elevational view of a third embodiment of the present invention, wherein the jaws are meshing gear-type surfaces used to maintain alignment of the jaws.

As indicated above, the fulcrum pin 63 is one preferred method of maintaining alignment of the first and second jaws 12 and 14. As illustrated in FIG. 9, a third embodiment of the invention 10" uses another method for maintaining alignment of the first and second jaws 12", 14", specifically, meshing gear type surfaces 60" and 62" on mating portions of the jaws 12" and 14". Assembly plate 44" is omitted from FIG. 9 to improve clarity of illustration of the meshing surfaces 60" and 62".

Figure 10:
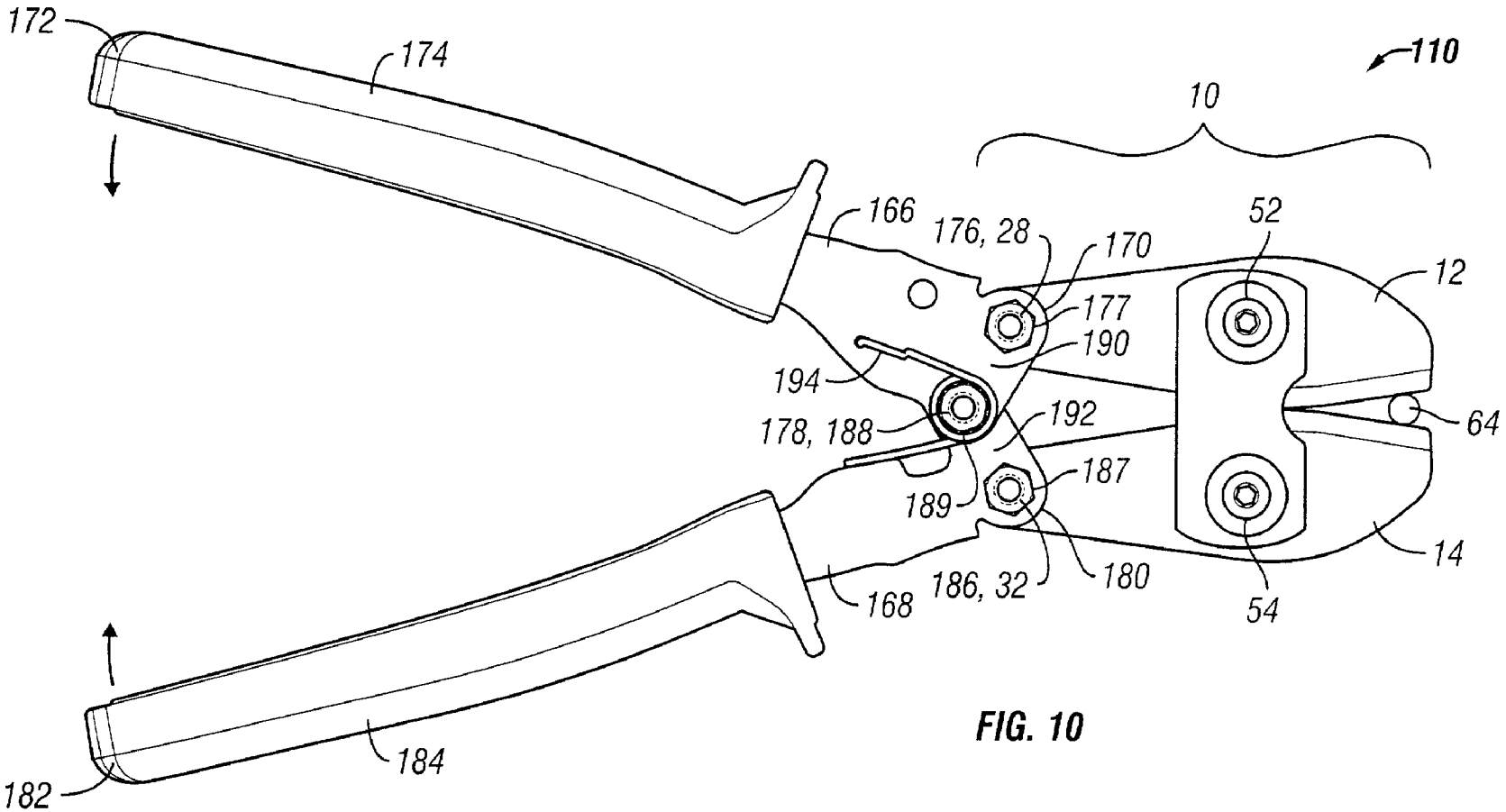
FIG. 10 is a right side elevational view of a fourth embodiment of the present invention, wherein the jaws of the cutting tool are opened and closed with hand levers, illustrating the jaws in their open position.
Figure 11:
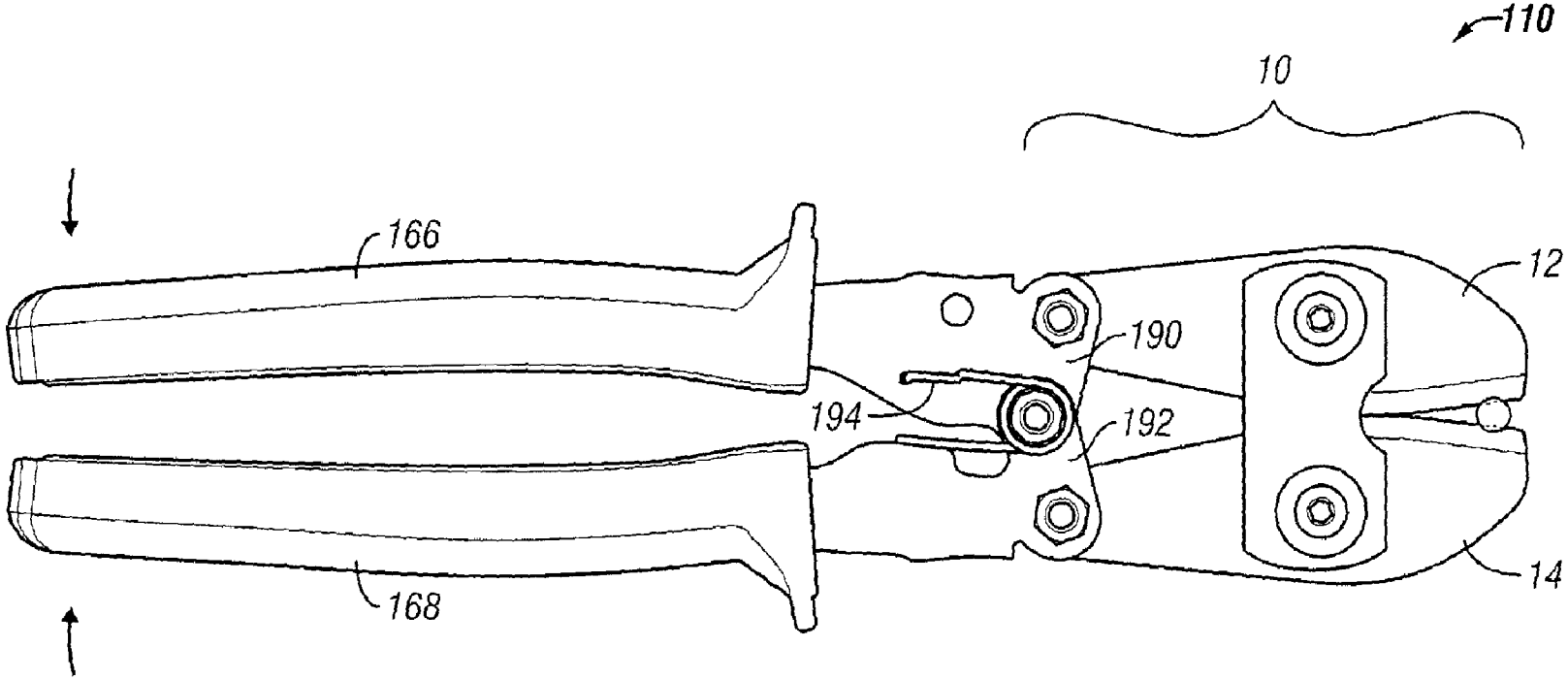
FIG. 11 is a right side elevational view of the hand tool of FIG. 10, illustrating the jaws in their closed position.

FIGS. 10 and 11 illustrate a fourth preferred embodiment of the present invention. A hand tool 110 is comprised of the cutting tool 10 of the first embodiment combined with manual means for applying actuating forces to the jaws 12 and 14. In this embodiment, first and second levers 166, 168 are connected to the jaws 12 and 14 and to each other. The first lever 166 includes a first end 170 and a second end 172. A handle portion 174 is intermediate the first 170 and second 172 ends. First and second through holes 176, 178 are provided at the first end 170 of the first lever 166. The first through hole 176 mates with the through hole 28 of the first jaw 12. The first lever 166 and the first jaw 12 are affixed together with attachment means, for example nut and bolt assembly 177. Similarly, the second lever 168 includes a first end 180 and a second end 182. A handle portion 184 is intermediate the first 180 and second 182 ends. First 186 and second 188 through holes are provided at the first end 180 of the second lever 168. The first through hole 186 mates with the through hole 32 of the second jaw 14. The second lever 168 and the second jaw 14 are affixed together with attachment means, for example nut and bolt assembly 187. The levers 166, 168 are also pivotally attached directly together at through holes 178, 188 by attachment means, for example nut and bolt assembly 189. The portion of the first lever between the first through hole 176 and the second through hole 178 thus forms a first linkage 190. Similarly, a second linkage 192 is formed by the portion of the second lever between the first through hole 186 and the second through hole 188. The jaws 12 and 14 may thus be viewed as being alternatively opened and closed by the oscillating pivoting motion of the linkages 190 and 192. The jaws 12 and 14 are put in an open position when the linkages 190 and 192 are pivoted away from the pivot points 24 and 38 (as illustrated in FIG. 10), and put in a closed position when the linkages 190 and 192 are moved in line with one another (as illustrated in FIG. 11). The levers 166 and 168 are biased into an open position by spring element 194.

The preferred material of construction for the levers 166 and 168 and the attachment means is hardened tool steel. Other materials, for example, stainless steel or other combinations of materials, for example hardened tool steel encased in a plastic coating, could be substituted. The preferred material of construction for the spring element 194 is spring steel.

From this disclosure, it would be obvious to one skilled in the art to modify the arrangement of the levers as shown. The length and thickness proportions of the levers with respect to the jaws 12 and 14 could be increased or decreased. The surface of the levers 166 and 168 could be modified to provide a non-slip grip. Cushioning materials (e.g. polypropylene foam) could be used to cover the levers 166 and 168.

Figure 12:
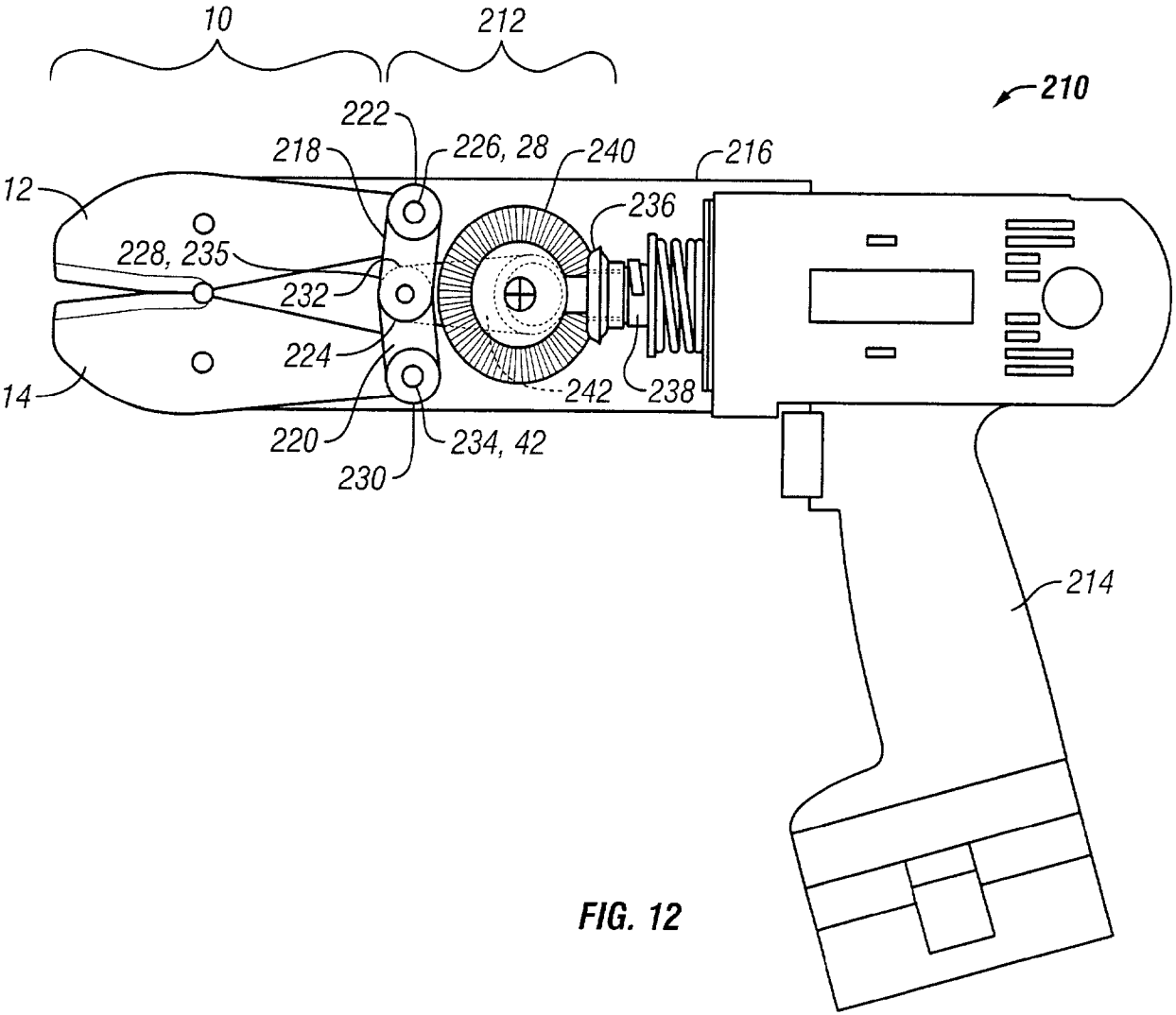
FIG. 12 is a left side elevational view of a fifth embodiment of the present invention, wherein the jaws of the cutting tool are operated by a hand-held motorized device and the jaws execute one cutting stroke per revolution of a bevel gear, with the jaws shown in a closed position.
Figure 13:
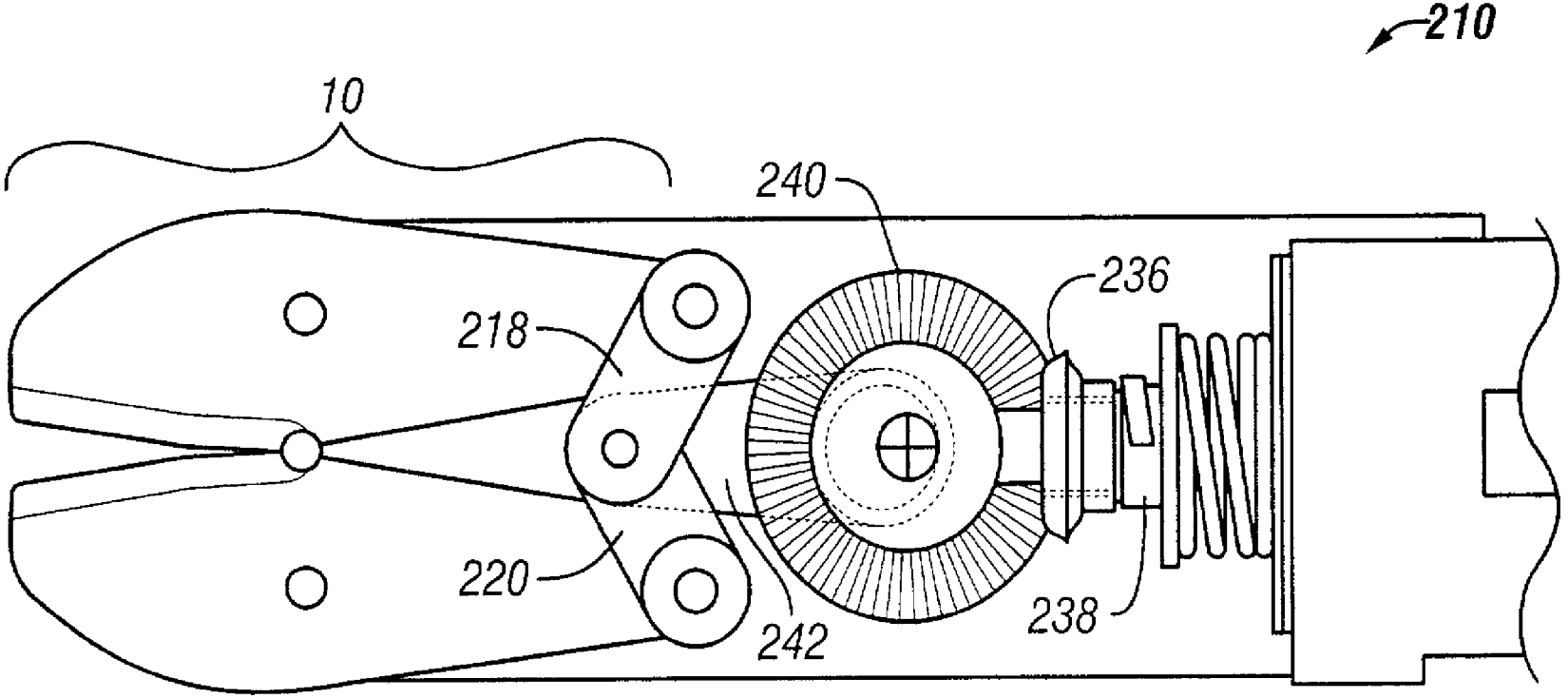
FIG. 13 is the hand tool of FIG. 12, with the jaws shown in an open position.

FIGS. 12 and 13 illustrate a fifth embodiment of the present invention. A motorized hand tool 210 is comprised of the first embodiment 10 of the cutting tool combined with a motorized drive for applying actuating forces to jaws 12 and 14. The motorized drive includes a drive mechanism 212, a hand-held motorized device 214, capable of rotating an output shaft at a suitable rotational velocity and of providing satisfactory torque to the output shaft and a housing 216 (note that a mating housing is omitted from the FIGS. to allow the internal mechanism to be seen). The hand-held motorized device 214 is a commercially available item, and may be purchased from Makita Power Tools, Model Number 6333D. The housing 216 attaches to the hand-held motorized device 214, and surrounds the drive mechanism 212 and a portion of the cutting tool 10 proximate ends 18 and 32. The housing 216 is attached to the jaws 12 and 14 in the same manner and functions in the same way as link 44. The drive mechanism 212 includes first 218 and second 220 linkages. The first linkage 218 has first 222 and second 224 ends. A first through hole 226 is provided at the first end 222 and a second through hole 228 is provided at the second end 224. The first linkage 218 is connected to the first jaw 12 by a fastener (e.g. a rivet, not shown) inserted in mating through holes 226 and 28. Similarly, the second linkage 220 has first 230 and second 232 ends. A first through hole 234 is provided at the first end 230 and a second through hole 235 is provided at the second end 232. The second linkage 220 is connected to the second jaw 14 by a fastener (e.g. a rivet, not shown) inserted in mating through holes 234 and 42.

The drive mechanism 212 further includes a bevel gear 236 mounted to an output shaft 238 of the hand-held motorized device 214. The bevel gear 236 drives another, larger bevel gear 240. A cam link 242 is connected at one end to the bevel gear 240. The cam link 242 is connected at its opposite end to the two links 218 and 220, at mating through holes 228, 235. As the output shaft 238 of the hand-held motorized device 214 rotates, the bevel gear 236 turns the larger bevel gear 240. As the bevel gear 240 rotates, the cam link 242 pushes the links 218 and 220 in an oscillatory pivoting motion. As illustrated in FIG. 12, when the cam link 242 is in a "three o'clock" position relative to the bevel gear 240, the links 218 and 220 are parallel to one another, and the jaws 12 and 14 of the cutting tool 10 are closed. As illustrated in FIG. 13, when the cam link 242 is in its "nine o'clock" position relative to the bevel gear 240, the links 218 and 220 are in their most forward pivoted configuration, and the jaws 12 and 14 are fully open.

The preferred material of construction for the linkages 218 and 220 and cam linkage 242 is hardened tool steel. Other materials, for example, stainless steel, could be substituted. The preferred material of construction for the pinion gear 236 and the bevel gear 242 is tool steel, but other materials (e.g. bronze) could be substituted. The preferred material of construction for the housing 216 is carbon steel, but other materials (for example, polypropylene, ABS or PVC) could be substituted.

From this disclosure, it would be obvious to one skilled in the art to modify the arrangement of the drive mechanism 212 as shown. For example, the sizes of the pinion gear 236 and the bevel gear 240 could be modified to change the performance characteristics of the drive mechanism 212.

Figure 14:
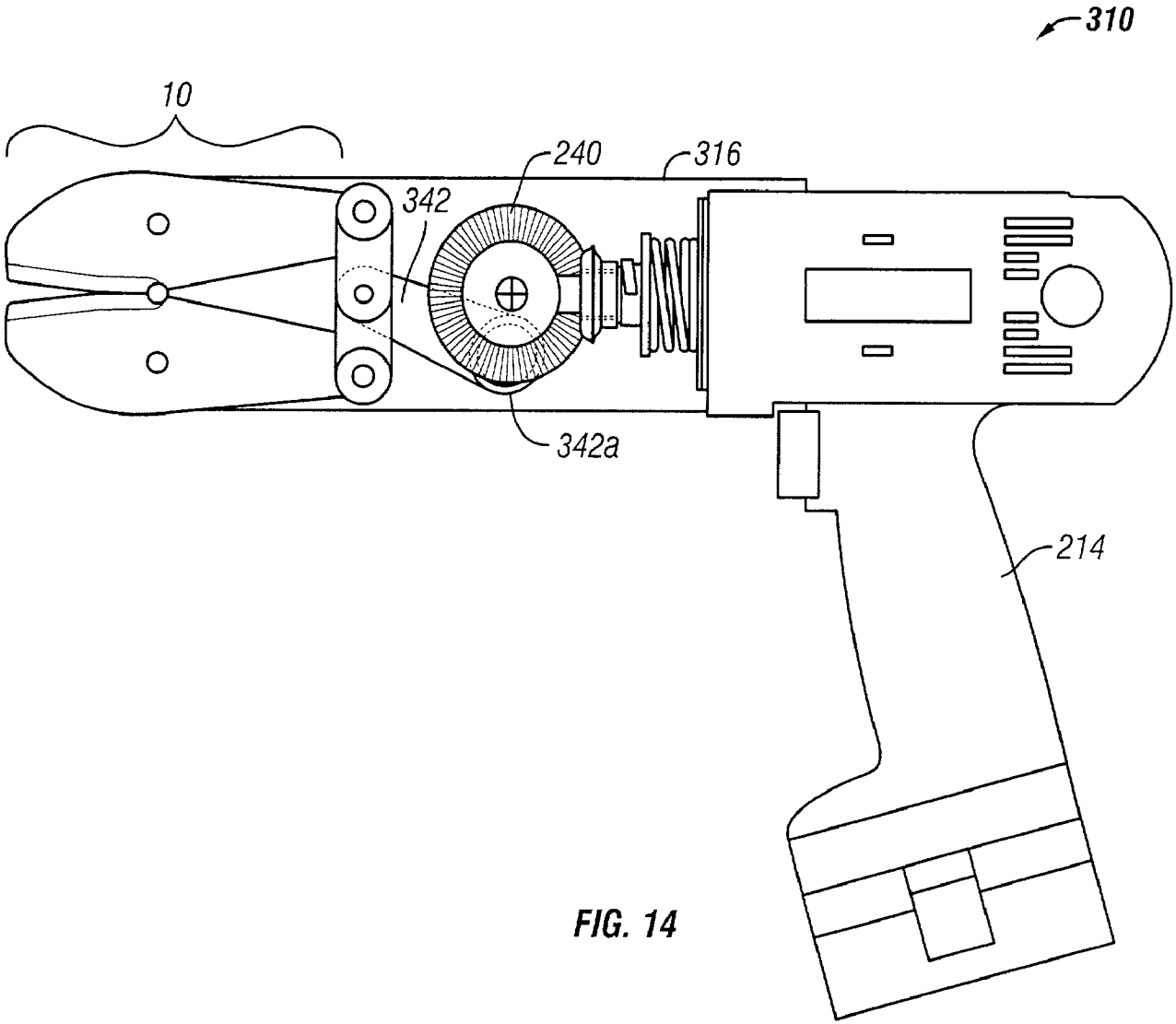
FIG. 14 is a left side elevational view of a sixth embodiment of the present invention, wherein jaws of the cutting tool are operated by a hand-held motorized device and the jaws execute two cutting strokes per revolution of a bevel gear, with the jaws shown in a closed position.
Figure 15:
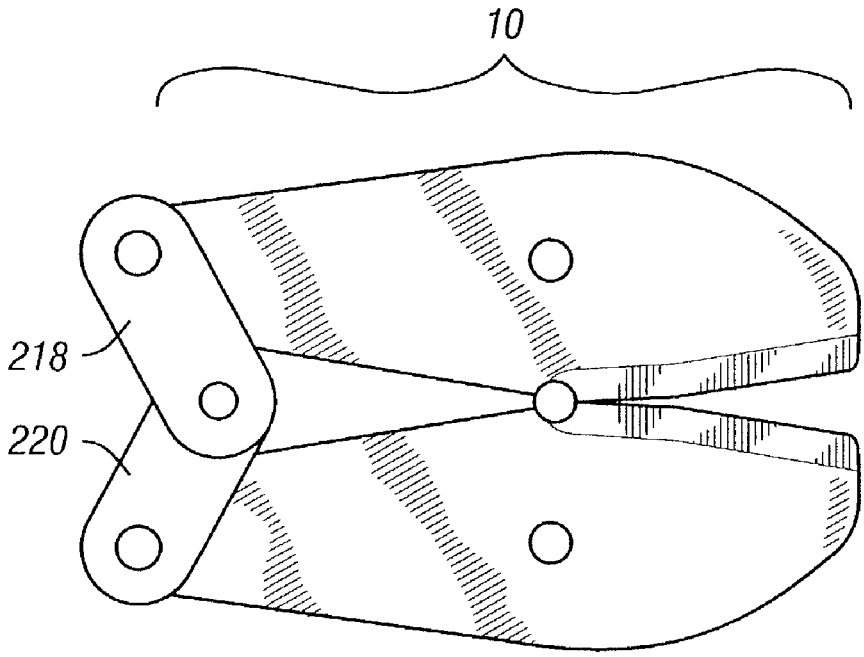
FIG. 15 is the hand tool of FIG. 14, with the jaws shown in a first open position.
Figure 16:
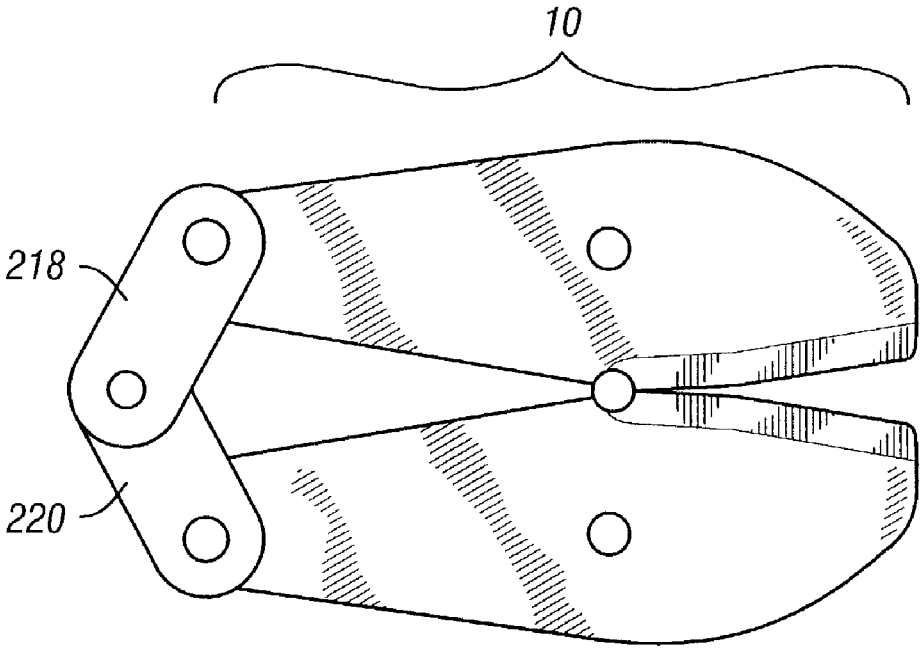
FIG. 16 is the hand tool of FIG. 14, with the jaws shown in a second open position.

A sixth embodiment of the present invention is illustrated in FIGS. 14–16. A motorized hand tool 310 is comprised of the first embodiment 10 of the cutting tool of the present invention and the hand-held motorized device 214 of the fifth embodiment of the present invention. The cam link 242 of the fifth embodiment of the present invention is modified in the sixth embodiment, resulting in cam link 342. Cam link 342 is larger at its base portion 342*a*, allowing the cam link 342 to be mounted to the bevel gear 240 farther from the center of rotation of the bevel gear 240, thus resulting in more highly eccentric motion than occurs in the fifth embodiment. This allows the cam link 342 to move through a longer stroke at its opposite end as the base portion 342*a* moves eccentrically about bevel gear 240. Additionally, the housing 316 of the sixth embodiment is lengthened relative to the housing 216 of the third embodiment to accommodate both the longer stroke and the increased length of the cam link 342. The motivation for increasing the stroke of the cam link 342 is to allow the jaws 12 and 14 to move through two full cutting cycles per full revolution of the bevel gear. As illustrated in FIG. 14, the cutting tool 10 is fully closed when the cam link 342 is at its "6 o'clock" position, as well as when it is at its "12 o'clock" position. FIGS. 15 and 16 illustrate that the jaws 12 and 14 are fully opened when the cam link is at its "3 o'clock" and "9 o'clock" positions.

Figure 17:
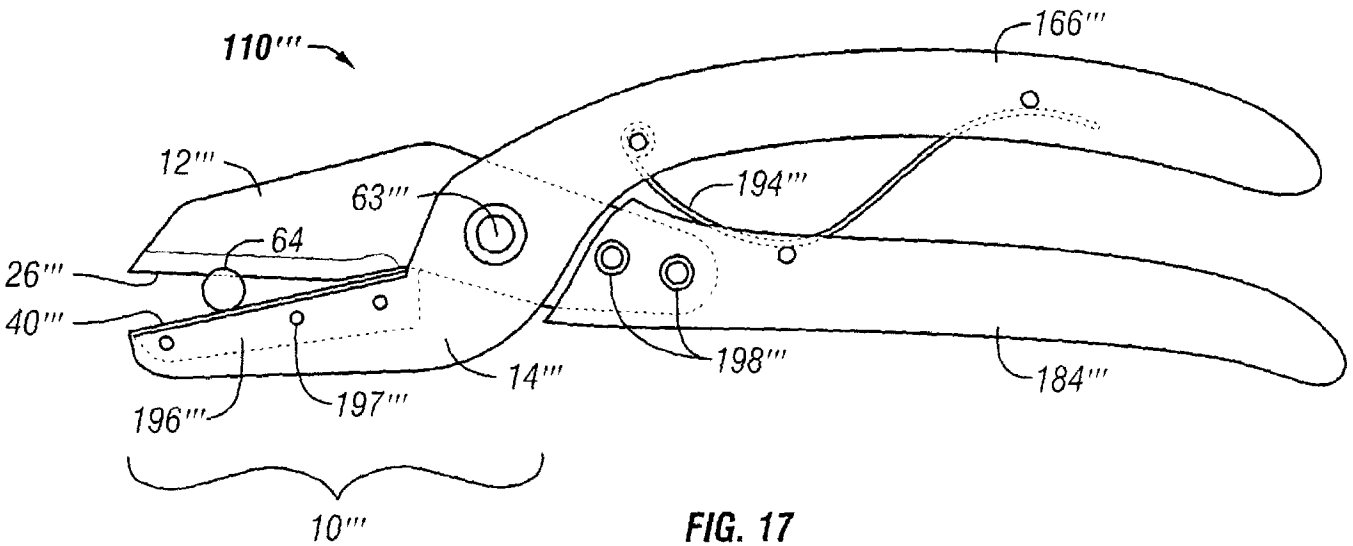
FIG. 17 is a left side elevational view of a seventh embodiment of the present invention, wherein one jaw is provided with a cutting edge and the second jaw is provided with an opposing cutting anvil; and, FIG. 18 is a front end view of the hand tool of FIG. 17.
Figure 18:
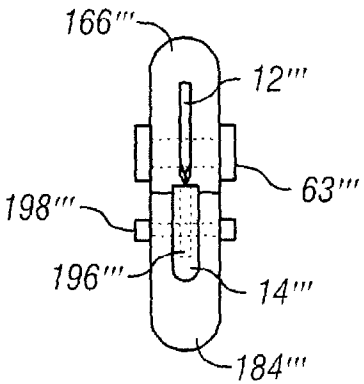

A seventh embodiment of the present invention is shown in FIGS. 17 and 18. This embodiment incorporates a fourth embodiment of the cutting tool, 10'''. In the fourth embodiment of the cutting tool 10''', the first jaw 12''' is provided with a cutting edge 26''', while the opposing edge 40''' of the second jaw 14''' forms a cutting anvil 196'''. The cutting anvil 196''' is formed by a metallic insert, preferably brass. The cutting anvil 196''' is secured into the second jaw 14''' by fasteners 197''', preferably rivets. The second jaw 14''' is integrally formed with a first actuating lever 166''', preferably formed from a rigid plastic material, such as ABS plastic. The first jaw 12''' is fixedly attached to a second actuating lever 184''' by fastening means 198''', preferably rivets. First jaw 12''' is preferably fabricated from hardened tool steel, while second actuating lever 184''' is preferably formed from a rigid plastic, such as ABS plastic. The first jaw 12''' is preferably provided with a coating, for example Teflon® or chrome to facilitate release of the workpiece 64 from the cutting edge 26'''. The first and second jaws 12''', 14''' are pivotally connected by fastening means 63''', preferably a rivet. A flat spring 194''' biases the first and second jaws 12''', 14''' in an open position.

From this disclosure, it would be obvious to one skilled in the art to modify the seventh embodiment 110''' of the present invention as shown. The cutting tool 10''', with its combination of a cutting edge 26''' with a cutting anvil 196''' could be incorporated into any of the foregoing embodiments.

A cutting tool 10, 10', 10'' and 10''' is thus disclosed, suitable for cutting thin or thick and hard (metal) or soft (wood) materials with reduced blade movement.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A cutting tool comprising:

a first jaw having first and second ends and first and second edges extending between the first and second ends, at least a portion of the first edge of the first jaw is tapered forming a cutting edge portion between the first and the second ends; and a second jaw having first and second ends and first and second edges extending between the first and second ends, at least a portion of the first edge of the second jaw facing the first edge of the first jaw;

the first and second jaws being pivotally connected together such that the first edge of the first jaw and the first edge of the second jaw oppose one another and pivot between a closed position and an open position, wherein, in the closed position, a part of the cutting edge portion of the first jaw and a part of the facing portion of the second jaw fully abut one another in a pliers action in an abutment section so as to prevent any further movement of the first and second jaws together and an angled gap is formed between a remaining free end of the cutting edge portion of the first edge of the first jaw and a remaining free end of the facing portion of the first edge of the second jaw, the remaining free ends of the first edges of the first and second jaws extending away from one another and from the abutment section.

2. The cutting tool of claim 1, wherein the facing portion of the first edge of the second jaw is tapered to form a cutting edge.

3. The cutting tool of claim 2 further comprising a rigid member pivotally supporting each of the first and second jaws.

4. The cutting tool of claim 2 further comprising means to rotate the first and second jaws relative to one another from the open position to the closed position.

5. The cutting tool of claim 4, wherein the means to rotate the first and second jaws is driven hydraulically.

6. The cutting tool of claim 4, wherein the means to rotate the first and second jaws is driven pneumatically.

7. The cutting tool of claim 2 further comprising:

a first handle with a first end and a second end, the first end of the first handle pivotally attached to the second end of the first jaw;

a second handle with a first end and a second end, the first end of the second handle pivotally attached to the second end of the second jaw;

the first end of the first handle and the first end of the second handle pivotally attached directly together, wherein upon pivotal movement of the first and second handles, the jaws may be rotated relative to one another between the open position and the closed position.

8. The cutting tool of claim 7, wherein a spring element biases the first and second handles in a position such that the first and second jaws are in the open position.

9. The cutting tool of claim 2 further comprising:

a first linkage having a first end and a second end, the first end of the first linkage pivotally connected to the second end of the first jaw;

a second linkage having a first end and a second end, the first end of the second linkage being pivotally connected to the second end of the second jaw;

the second end of the first linkage and the second end of the second linkage being pivotally connected, wherein upon an oscillatory pivoting movement of the first and second linkages relative to one another, the jaws are rotated relative to one another from the open position to the closed position.

10. The cutting tool of claim 9, wherein the oscillatory pivoting motion of the first and second linkages is caused by a mechanical drive system.

11. The cutting tool of claim 10, wherein the mechanical drive system comprises:

a hand-held motorized device including an output shaft;

a pinion gear attached to the output shaft;

a bevel gear operatively connected to the pinion gear;

a cam linkage connected to the bevel gear;

the cam linkage connected to the first and second linkages, wherein as the output shaft of the hand-held motorized device rotates, the first and second linkages move in the oscillatory pivoting motion.

12. The cutting tool of claim 11, wherein a full rotation of the bevel gear results in one cycle of motion of the first and second jaws between the open and closed positions.

13. The cutting tool of claim 11, wherein a full rotation of the bevel gear results in two cycles of motion of the first and second jaws between the open and closed positions.

14. The cutting tool of claim 1, wherein the facing portion of the first edge of the second jaw forms an anvil against which the cutting edge strikes in the abutment section.

15. The cutting tool of claim 14 further comprising a rigid member pivotally supporting each of the first and second jaws.

16. The cutting tool of claim 14 further comprising means to rotate the first and second jaws relative to one another from the open position to the closed position.

17. The cutting tool of claim 16, wherein the means to rotate the first and second jaws is driven hydraulically.

18. The cutting tool of claim 16, wherein the means to rotate the first and second jaws is driven pneumatically.

19. The cutting tool of claim 14 further comprising:

a first handle with a first and a second end, the first end of the handle formed integrally with the second end of the first jaw;

a second handle with a first end and a second end, the first end of the second handle fixedly attached to the second end of the second jaw, wherein upon pivotal movement of the first and second handles, the jaws may be rotated relative to one another between the open position and the closed position.

20. The cutting tool of claim 19, wherein a spring element biases the first and second handles in a position such that the first and second jaws are in the open position.

21. The cutting tool of claim 14 further comprising:

a first linkage having a first end and a second end, the first end of the first linkage pivotally connected to the second end of the first jaw;

a second linkage having a first end and a second end, the first end of the second linkage being pivotally connected to the second end of the second jaw;

the second end of the first linkage and the second end of the second linkage being pivotally connected, wherein upon an oscillatory pivoting movement of the first and second linkages relative to one another, the jaws are rotated relative to one another from the open position to the closed position.

22. The cutting tool of claim 21, wherein the oscillatory pivoting motion of the first and second linkages is caused by a mechanical drive system.

23. The cutting tool of claim 22, wherein the mechanical drive system comprises:

a hand-held motorized device including an output shaft;

a pinion gear attached to the output shaft;

a bevel gear operatively connected to the pinion gear;

a cam linkage connected to the bevel gear;

the cam linkage connected to the first and second linkages, wherein as the output shaft of the hand-held motorized device rotates, the first and second linkages move in the oscillatory pivoting motion.

24. The cutting tool of claim 23, wherein a full rotation of the bevel gear results in one cycle of motion of the first and second jaws between the open and closed positions.

25. The cutting tool of claim 23, wherein a full rotation of the bevel gear results in two cycles of motion of the first and second jaws between the open and closed positions.

* * * * *